US005105510A

United States Patent [19]

Roulin et al.

[11] Patent Number: 5,105,510

[45] Date of Patent: Apr. 21, 1992

[54] TELESCOPICALLY EXTENSIBLE BRACELET CLASP

[75] Inventors: Philippe Roulin, St-Imier; Roland Streule, Granges; Pierre-Alain Walder, Bienne, all of Switzerland

[73] Assignee: Montres Rado S.A., Lengnau, Switzerland

[21] Appl. No.: 728,299

[22] Filed: Jul. 11, 1991

[30] Foreign Application Priority Data

Jul. 11, 1990 [FR] France ..... 90 08925

[51] Int. Cl.[5] ..... A44C 5/18

[52] U.S. Cl. ..... 24/68 J

[58] Field of Search ..... 24/68 R, 68 J, 69 J, 24/70 J, 71 J; 224/176; 63/32

[56] References Cited

U.S. PATENT DOCUMENTS 1,796,341 3/1931 Otten .
1,801,963 4/1931 Kliem .
2,471,300 5/1949 Block .
2,526,023 10/1950 Greenberg .
3,901,717 8/1975 Revaz ..... 63/32 X

FOREIGN PATENT DOCUMENTS 3520122 6/1984 Fed. Rep. of Germany .
670664 12/1929 France .
1512427 1/1968 France .
2502916 3/1981 France .

*Primary Examiner*—James R. Brittain
*Attorney, Agent, or Firm*—Griffin Branigan & Butler

[57] ABSTRACT

The clasp (1) is telescopically extensible. It includes a first tubular element (2) capped on its upper and lateral faces by a plurality of links (5) resembling those employed for the rest of the bracelet. Into the first element there may be introduced a second tubular element (8) which in turn is adapted to accommodate a third element (10) in the form of a plate to which is attached a blocking system in order to maintain the clasp in its retracted position. The clasp is for a bracelet and shows no greater thickness relative to the links forming said bracelet.

9 Claims, 3 Drawing Sheets

TELESCOPICALLY EXTENSIBLE BRACELET CLASP

This invention concerns an extensible clasp for a bracelet formed by links, including at least three elements having an essentially flat elongated form sliding relative to one another so as to constitute a telescopically extensible clasp adapted to assume an extended and a retracted position.

BACKGROUND OF THE INVENTION

In clasps referred to as unfolding buckle or portfolio, one generally finds at least two rigid blades hinged to one another, the free end of each of such blades being fastened respectively to each strand exhibited by the bracelet. This is the case, for instance, for the clasp described in U.S. Pat. No. 1,796,341. In models of this type, the bracelet links are superposed on the folded back arms of the clasp in a manner such that the bracelet exhibits a greater thickness at the place of such clasp.

The bracelet clasp described in the patent document DE-A-3 520 122 likewise includes two plates which are folded one over the other and each of which is attached to a bracelet strand formed of links. In this model, at least one of the two plates includes two elements which may slide in a telescopic manner within one another and in the longitudinal direction of the bracelet. In this manner, and although the clasp includes only two plates, such clasp may be extended, once opened, over a distance greater than that of the sum of the lengths of each of the plates. This system enables shortening the rigid portion exhibited by the bracelet in the closed position while permitting a great extension of the latter in the open position. However, in spite of the advantages set forth hereinabove and that one will find partially in the present invention, one strand of the bracelet of the cited document is also located superposed on the clasp in the closed position, thus creating an apparent greater thickness.

Finally, it will be noted that a clasp including three elements sliding relative to one another in order to constitute a telescopically extensible clasp is described in the U.S. Pat. No. 1,801,963. However, no link of the bracelet covers this clasp and even if one were to apply to said clasp the teaching of documents U.S. Pat. No. 1,796,341 or DE-A-3 520 122, such links would allow the clasp to appear once such clasp was retracted in its closed position.

The bracelet of this invention mitigates the cited difficulty in retracting the clasp within the thickness of the bracelet links in a manner such that said bracelet appears to be without a thickness discontinuity at the place of the clasp, such clasp exhibiting furthermore a closed rigid portion of reduced length while permitting a great elongation of the bracelet in the open position.

SUMMARY OF THE INVENTION

In order to arrive at this result, the clasp of the invention is characterized in that the first element is capped over its upper face and at least a portion of its lateral faces by a plurality of juxtaposed links, such links being retained by the first element in order to form a rigid end zone of a first bracelet strand, that the second element is slidingly mounted relative to the first, first retaining means preventing said first and second elements from separating from one another and that the third element is slidingly mounted relative to the second, second retaining means preventing said second and third elements from separating from one another, the free end of the third element being fixed to the end of the second strand of the bracelet through a blocking system which maintains the clasp in its closed state when said clasp is in its retracted position.

The invention will be understood upon reading the description to follow by way of example, such description being illustrated by the drawings.

DESCRIPTION OF THE PREFERRED EMBODIMENTS

Figure 1:
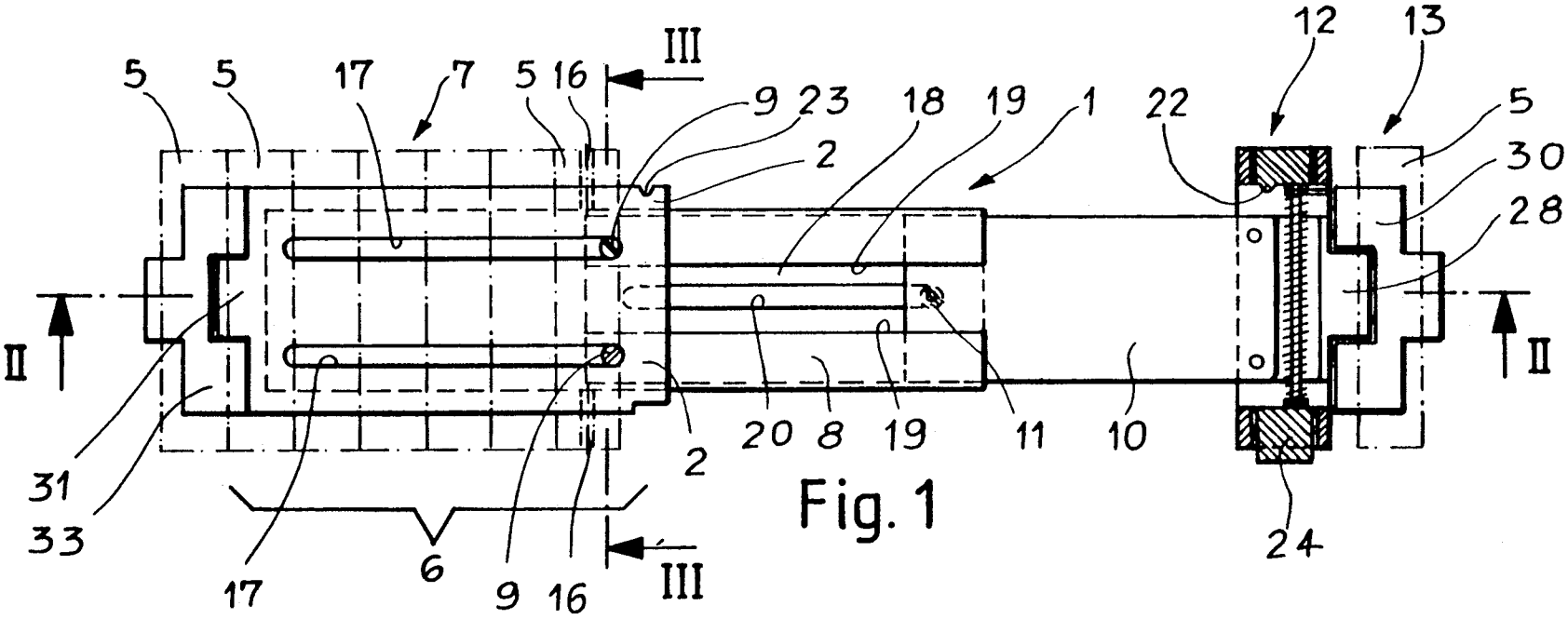
FIG. 1 is a top view of the clasp of the invention according to a first embodiment.
Figure 2:
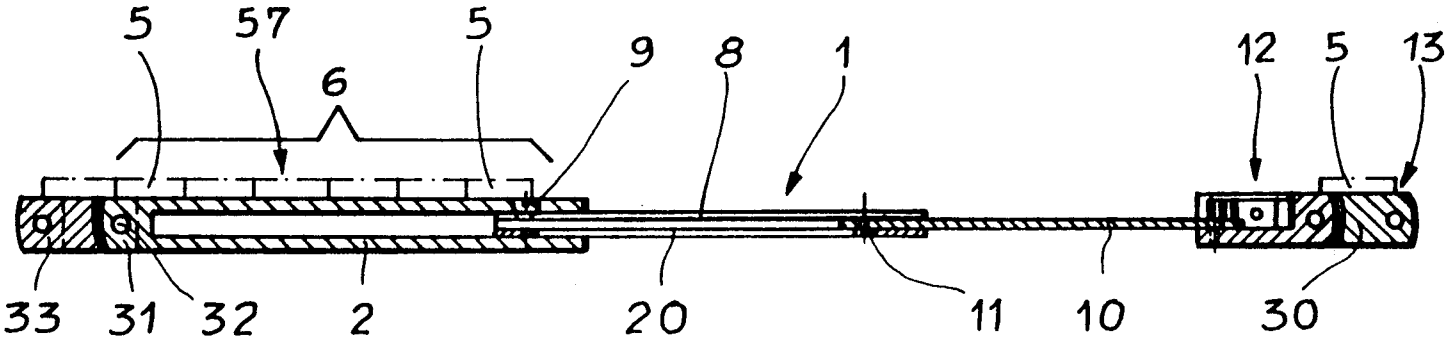
FIG. 2 is a cross-section along line II—II of FIG. 1.
Figure 3:
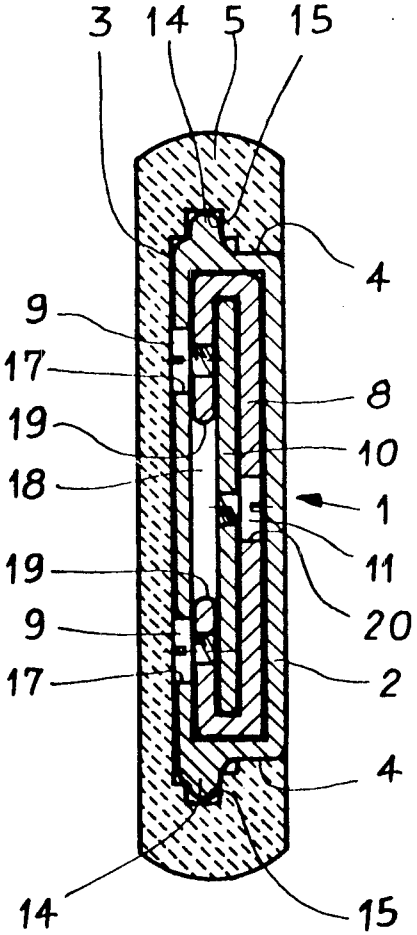
FIG. 3 is a cross-section along line III—III of FIG. 1, the clasp being supposed to be in its closed position.
Figure 7:
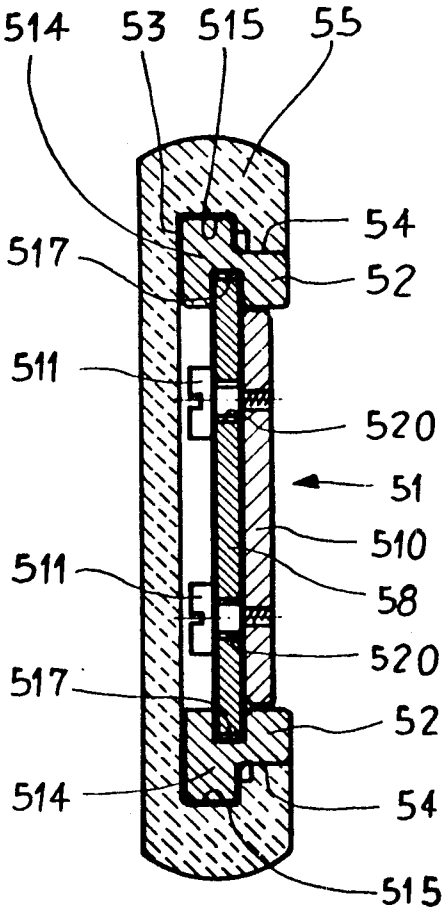
FIG. 7 a cross-section along line VII—VII of FIG. 5, the being supposed to be in closed position.
Figure 5:
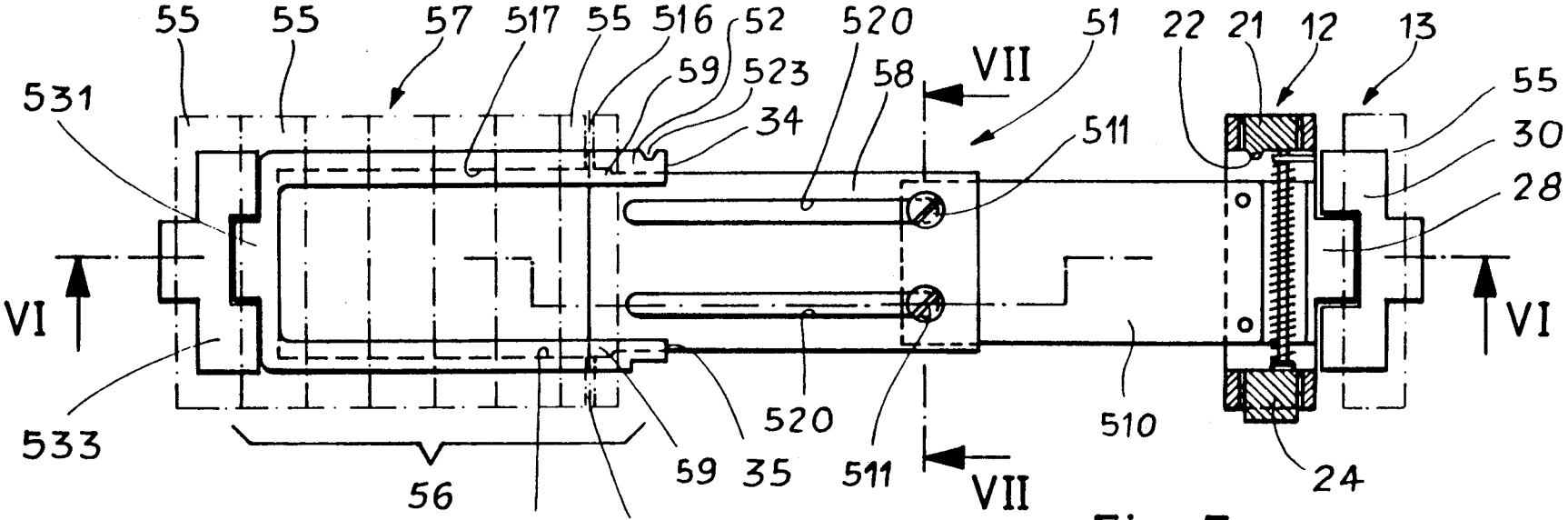
FIG. 5 is a top view of the clasp of the invention according to a second embodiment.
Figure 6:
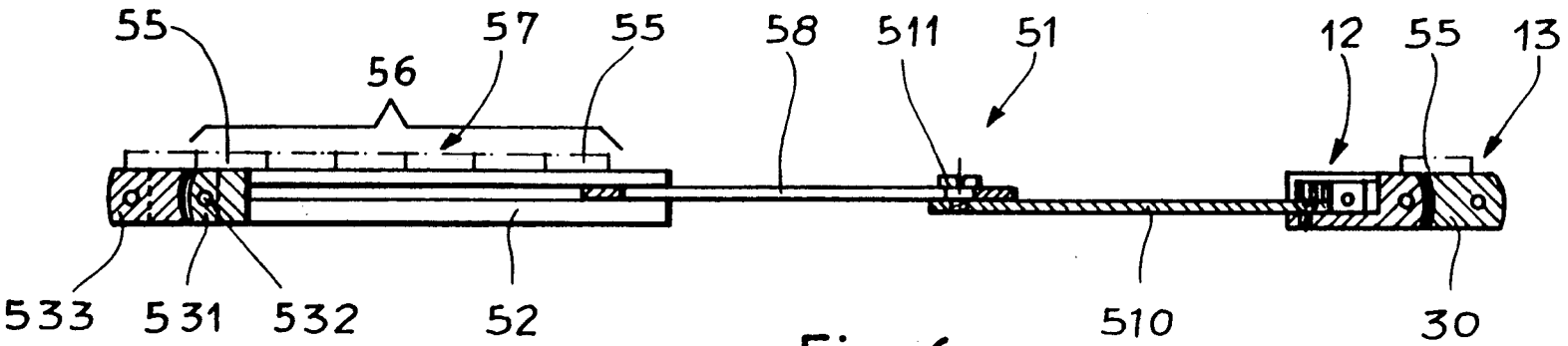
FIG. 6 is a cross-section along line VI—VI of FIG. 5.

As is seen on FIGS. 1 to 3 as well as on FIGS. 5 to 7 the extensible clasp 1, 51 for bracelets having links includes three main elements of an essentially flattened and elongated form, such elements sliding relative to one another in order to constitute a telescopically extensible clasp. The general characteristics of the clasp will now be explained with reference to the mentioned drawings while observing that it may include more than three telescopic elements, a fourth for instance, which would enable a greater extension.

The clasp includes a first element 2, 52 which is capped on its upper face 3, 53 and over at least a portion of its lateral faces 4, 54 by a plurality of juxtaposed links 5, 55, such links being retained by this first element in order to form a rigid end zone 6, 56 terminating a first strand 7, 57 of the bracelet. FIGS. 3 and 7 show that the lateral faces 4 and 54 are entirely covered over by links 5 and 55, but the first elements 2 and 52 could emerge slightly from the corresponding links, in which case the lateral faces of said first elements would be only partially recovered by the links.

The clasp further includes a second element 8, 58 which is slidingly mounted relative to the first element 2, 52, retaining means referenced respectively 9 and 59 preventing said first and second elements from separating from one another.

The clasp finally includes a third element 10, 510 which is slidingly mounted relative to the second element 8, 58, retaining means respectively referenced 11 and 511 preventing said second and third elements from separating from one another.

In the two embodiments of the invention, FIGS. 1 to 3, respectively 5 to 7, show that the free end of the third element 10, 510 is attached to a blocking system referenced 12 which maintains the clasp in its closed state when such clasp is in its retracted position. To the blocking system there is then attached a second bracelet strand 13.

There will now be described in detail a first embodiment of the invention, being that shown on FIGS. 1 to 3. The first element of the clasp is here a first tube 2 having a rectangular profile as may be readily seen on FIG. 3. Such tube extends in the longitudinal direction of the bracelet and bears on each of its lateral faces 4 a longitudinal projection 14 which is engaged in a slideway 15 provided on the interior of each of the lateral portions exhibited by links 5 in order to maintain such links retained by tube 2. FIG. 1 further shows that in order to prevent the last link of the first strand from escaping from tube 2, there are arranged pins in holes 16 pierced in succession in the link and in the tube. Here it will be mentioned that the system of projections and slideways as well as the arrangement with pins could be replaced by other arrangements, the essential point residing in the fact that the end of the first strand 7 is fixedly retained on tube 2. Tube 2 includes two first slots 17 provided on its major upper face, such slots extending in the longitudinal direction of tube 2. The end of tube 2 located to the left on FIGS. 1 and 2 shows a projection 31 pierced with a hole 32 serving to attach to the clasp, for instance a link 33 forming the beginning of an interior linked chain covered in turn by link 5 forming the continuation of the first bracelet strand. Such an arrangement is set forth for instance in the patent document FR-A-2 502 916.

The second element of the clasp is a second tube 8 having a rectangular profile adapted to be engaged in the first tube 2 as is well shown on FIG. 3. The first of the major faces of the second tube 8 bears two first retaining devices 9 capable of sliding in the first slots 17 of the first tube 2. Although any other means may be employed, here screws are used screwed into the second tube 8, the screw heads sliding in the first slots 17. Thus, thanks to this arrangement, the second tube 8 is retained in the first tube 2 and its course is limited by the first slots 17. Although not indispensable, FIGS. 1 and 3 show that the first of the major faces of the second tube 8 includes a central opening 18 limited by two edges 19, such opening extending throughout the entire length of the second tube. This type of arrangement may facilitate manufacture of the second tube 8. The second tube 8 further includes a second slot 20 pierced in its second major face, extending in the longitudinal direction of tube 8.

Finally, the third element of the clasp is a plate 10 of rectangular cross-section adapted to be engaged in the second tube 8. This plate bears a second retaining device 11 capable of sliding in the second slot 20 of the second tube 8. As previously, a screw is employed here screwed into plate 10, the head of such screw sliding in the second slot 20, although other means could be employed. Also plate 10 is retained in tube 8 and its course is limited by the length of slot 20.

Figure 4:
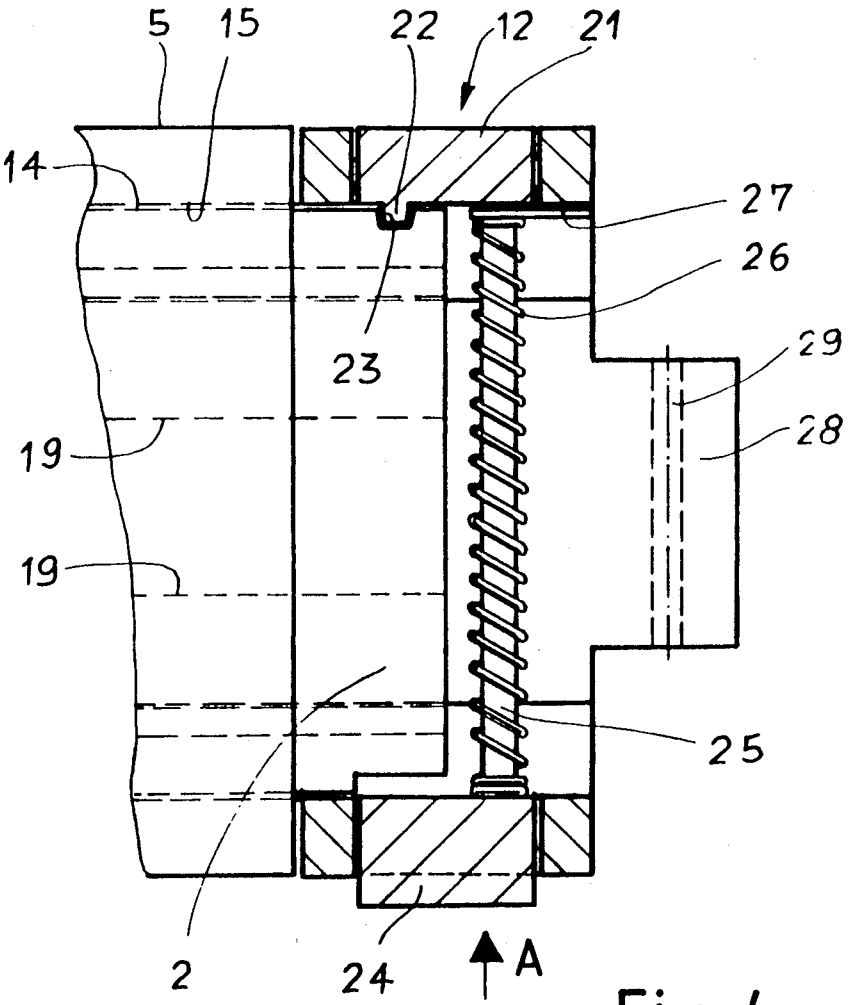
FIG. 4 shows in detail a blocking system which maintains the clasp of the preceding figures in its closed state.

The free end of plate 10 bears a blocking system 12 enabling the maintenance of the clasp in a retracted or closed position. This system may assume various forms. One of the latter is shown in detail on FIG. 4 which shows the clasp in a closed position. The blocking system 12 is a special element, the width and thickness of which are approximately equal to the width and thickness of the links 5 of the bracelet. Essentially, such blocking element is a latching bolt 21, the latch element 22 of which cooperates with a notch 23 provided in the first element 2 of the clasp in order to maintain such clasp in a closed position. The latching bolt is situated on one of the lateral faces of the special element, while on the opposite lateral face is situated a push-button 24 connected to the latching bolt by a stem 25 around which is wrapped a return spring 26, such latter bearing on the push-button 24 on one hand and on the other hand on a pierced plate 27 integrally formed with the special element. FIG. 4 shows that when the push-button 24 is pressed in the sense of arrow A, the latching bolt 21 emerges from element 12 and disengages the latch 22 from notch 23 in a manner such that the clasp may be unfolded. When the clasp is in the retracted position, the latch 22 falls into notch 23, pulled back as it is by spring 26. FIG. 4 further shows that a projection 28 pierced by a hole 29 is fixed to the blocking element 12 in a manner such that one may attach thereto for instance a link 30 forming the beginning of an interior linked chain covered in turn by links 5 forming the second strand of the bracelet (see also FIGS. 1 and 2).

There will now be described in detail a second embodiment of the invention, being that shown on FIGS. 5 to 7. The first element of the clasp is here a part 52 having the form of a U, the two branches 34 and 35 of which extend in the longitudinal direction of the bracelet. FIG. 7 shows that the outer faces of these branches each include a horizontal projection 514 which is engaged in a slideway 515 provided on the interior of the lateral portions exhibited by links 55 in order to keep such links retained in the U formed part 52. FIG. 5 shows that in order to prevent the last link 55 of the first strand 57 from escaping from the U formed part 52, there are arranged pins in holes 516 pierced in succession in the link and in the U formed part. As was noted with respect to the preceding embodiment, the system of projections and slideways as well as the arrangement using pins could be replaced by other arrangements without departing from the main idea of this invention.

Each cross-section of the U formed part 52 includes a slideway 517 provided on the interior face of the branches. FIG. 5 shows that the depth of the slideways is reduced at each of the ends of branches 34 and 35.

The second element of the clasp is a rectangular plate 58 provided with two slots 520 extending in the longitudinal direction of the bracelet. As is seen on FIG. 5, plate 58 is wider in the neighborhood of its left hand end and thus exhibits two projections 59 which when the clasp is entirely folded out, are brought to abut against the narrowed portions included in the slideways 517, such narrowed portions at the end of branches 34 and 35 forming stops.

Finally, the third element of the clasp is also a rectangular plate 510 provided with at least one guiding organ 511 arranged so as to slide in slot 520 of the second element. As shown by FIGS. 5 to 7, organ 511 is a bearing screw threaded into plate 510 and traversing plate 58 at the place of said bearing surface. The head of the screw maintains the two plates against one another. In the example shown, there are preferably employed two screws in place of one with the purpose of obtaining a better guidance of one plate relative to the other. Thus, in this system, plate 510 is retained under plate 58 and its course is limited by the length of slots 520.

FIGS. 5 and 6 show that the free end of plate 510 bears a blocking system 12 identical to that described with reference to the first embodiment of the invention. There is thus no need to return to this in detail. However, here the latch 22 of the latching bolt 21 cooperates with a notch 523 provided at the end of the branch 34 of the U formed part 52.

In this second embodiment, the second strand of the bracelet is attached to the blocking system 12 in the same manner as that already set out with reference to the first embodiment. As far as the first strand of the bracelet is concerned, it will be noted that the bridge connecting the two branches of the U exhibits a projection 531 from a hole 532 serving to attach to the clasp a link 533 forming the beginning of an articulated chain covered in turn by links 55 forming the continuation of the first bracelet strand.

From the explanations which have been given hereinabove, there results above all from the cross-sections shown on FIGS. 3 and 7 that the clasp once retracted may find place entirely within the links forming the bracelet and that it therefore causes no extra thickness as is the case with the portfolio clasps. It will be also noted that since it is formed of three telescopic elements, its rigid portion is reduced to a minimum, that is to say, to the length of the first element which moreover may be slightly inwardly curved as also the other two elements cooperating therewith. There will also be noted that the links covering the bracelet in its flexible portion may be the same as those covering the clasp portion, and this also in respect of the form of the interior slideways, which avoids two types of different parts. This is advantageous should one employ links of material which is difficult to machine, for example of hard metal or ceramic. Furthermore, the manner of retaining the links by the clasp then by an interior chain beyond such clasp by means of slideways formed in the link simplifies the manufacture of the link which does not include any hole, such being always difficult to provide should such links be formed of ceramic material.

What we claim is:

1. An extensible clasp for a bracelet formed by links including at least three elements having an essentially flat elongated form sliding relative to one another so as to constitute a telescopically extensible clasp adapted to assume an extended and a retracted position, the first element being capped over its upper face and on at least a portion of its lateral faces, a plurality of juxtaposed links, said links being retained by the first element in order to form a rigid end zone of a first strand of the bracelet, the second element being slidably mounted relative to the first element, first retaining means preventing said first and second elements from separating from one another, and the third element being slidably mounted relative to the second element, second retaining means preventing said second and third elements from separating from one another, the free end of the third element being fastened to the end of a second strand of the bracelet through a blocking system which maintains the clasp in the closed state when said clasp is in said retracted position.

2. A clasp as set forth in claim 1 wherein the first element is a first tube having a rectangular profile extending in the longitudinal direction of the bracelet, two first slots being provided in one of the major faces of the tube, said slots extending in said longitudinal direction, the second element being a second tube of rectangular profile adapted to be engaged in the first tube, the first of the major faces of said second tube bearing two first retaining devices capable of sliding in the first slots of said first tube, the second major face of said second tube being pierced by a second slot and the third element being a plate of rectangular section adapted to be engaged in the second tube, said plate bearing a second retaining device capable of sliding in the second slot of said second tube.

3. A clasp as set forth in claim 2 wherein the first and second retaining devices are screws which are respectively screwed into the second tube and into the plate. with the screw heads sliding respectively in the first and second slots.

4. A clasp as set forth in claim 2 wherein the first major face of the second tube includes a central opening extending over the length of said second tube.

5. A clasp as set forth in claim 1 wherein the first element exhibits the form of a U the two branches of which extend in the longitudinal direction of the bracelet, each of the internal faces of said branches being provided with a slideway, the second element being a rectangular plate provided with at least one slot extending in said longitudinal direction, the edges of said plate being arranged to slide in the respective slideways of said first element, and the third element being a rectangular plate provided with at least one guiding organ arranged so as to slide within the slot of said second element.

6. A clasp as set forth in claim 1 wherein the blocking system is a latching bolt borne by the free end of the third element, said bolt cooperating with a notch formed in the first element in order to maintain the clasp in its closed state.

7. A clasp as set forth in claim 1 wherein each of the lateral faces of the first element bears a longitudinal projection engaged in a slideway provided on the interior of each of the lateral portions exhibited by the links in order to maintain retention of said links by said first element.

8. A clasp as set forth in claim 1 wherein the links are formed of material which may be machined only with difficulty.

9. A clasp as set forth in claim 8 wherein the links are formed of ceramic material.

* * * * *